US005494064A

United States Patent [19]

Chuang Lee

[11] Patent Number: 5,494,064

[45] Date of Patent: Feb. 27, 1996

[54] SAFETY RUNNER FOR USE IN AN UMBRELLA

[76] Inventor: Heng T. Chuang Lee, 58, Ten Hsin Li, Hsin Pu Chang, Chinchu Shien, Taiwan

[21] Appl. No.: 433,215

[22] Filed: May 2, 1995

[51] Int. Cl.[6] ..... A45B 25/06

[52] U.S. Cl. ..... 135/28; 135/38

[58] Field of Search ..... 135/28, 37, 38, 135/39, 41, 43

[56] References Cited

U.S. PATENT DOCUMENTS

| | | | |
|---|---|---|---|
| 2,740,417 | 4/1956 | Klein | 135/41 |
| 3,419,026 | 12/1968 | Evans, Jr. et al. | 135/38 X |
| 3,424,180 | 1/1969 | Andolfi | 135/39 |
| 5,275,186 | 1/1994 | Liu | 135/38 X |
| 5,357,994 | 10/1994 | Chung | 135/28 X |

FOREIGN PATENT DOCUMENTS

| | | | |
|---|---|---|---|
| 1562049 | 2/1969 | France | 135/38 |

*Primary Examiner*—Lanna Mai

*Attorney, Agent, or Firm*—Morton J. Rosenberg; David I. Klein

[57] ABSTRACT

The present invention relates to a safety runner for use in an umbrella, which makes use of a slidable sleeve that has an internal flange at the upper portion thereof and rides on a runner element embracing an umbrella rod; by means of a slide motion of the sleeve relative to the runner element, a resilient bow lever housed in the umbrella rod being depressed by the internal flange to release the detention of the runner so that users can close the umbrella in an easy and safe way.

1 Claim, 4 Drawing Sheets

SAFETY RUNNER FOR USE IN AN UMBRELLA

SUMMARY OF THE INVENTION

Most conventional umbrellas use a spring bow element housed in an umbrella rod to keep a runner in a certain position so that umbrellas can be maintained in an open state. When the closure of umbrellas is desired, users press down the spring bow element by a finger to release the detention of the runner so that the runner can move down to close an umbrella. During the operation of an umbrella the runner moves rapidly and so users' fingers are often clamped due to carelessness, resulting in annoying hurts.

In view of the above shortcoming, the primary object of the invention is to provide a safety runner that enables users to close an umbrella by pulling down a slidable sleeve without dangers of clamping fingers.

BRIEF DESCRIPTION OF THE DRAWINGS

The structure, features, and advantages of the invention will be explained in the following detailed description with reference to the accompanying drawings.

DETAILED DESCRIPTION OF A PREFERRED EMBODIMENT

Figure 1:
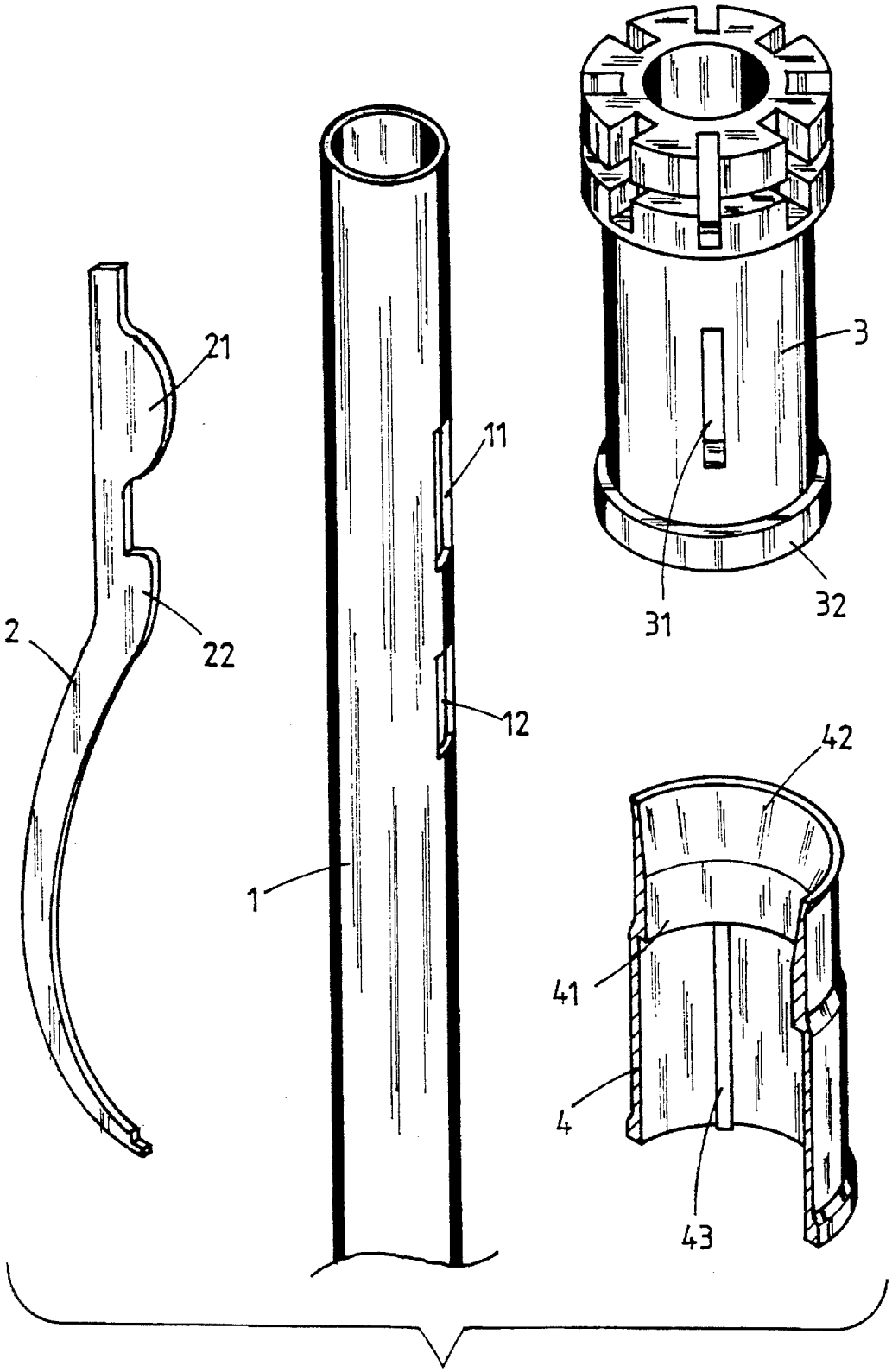
FIG. 1 is a perspective view depicting main parts of an embodiment of a safety runner according to the invention.
Figure 2:
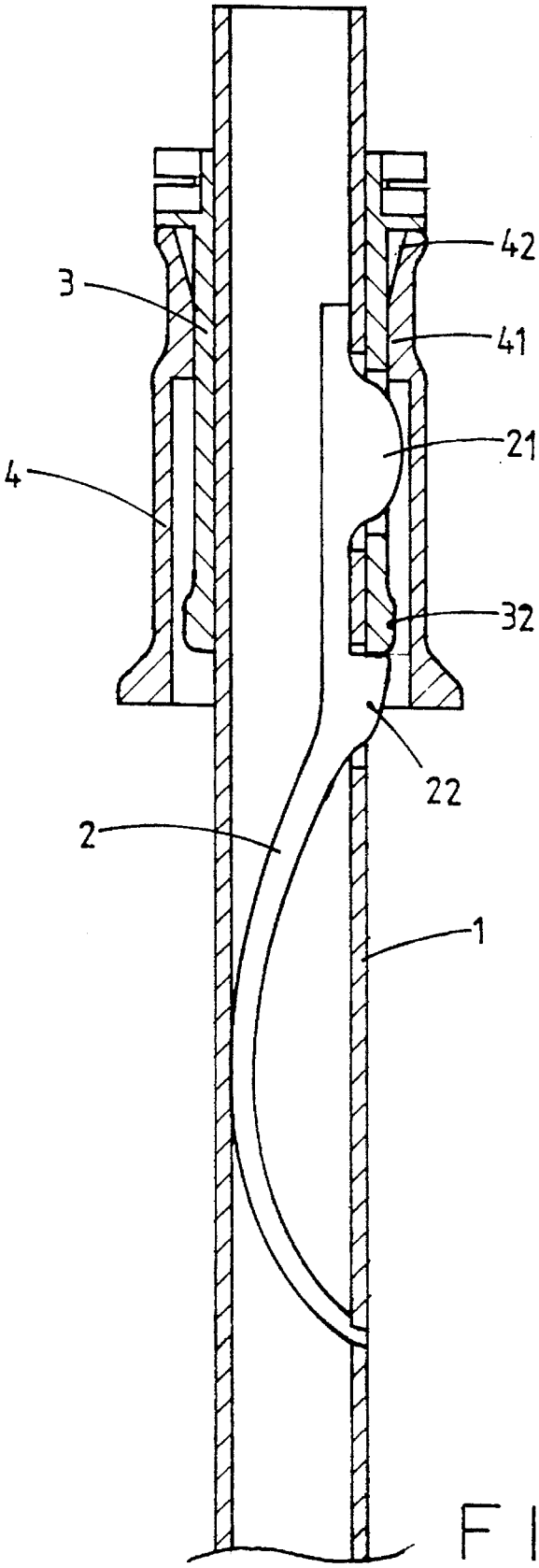
FIG. 2 is an assembly drawing of the safety runner of FIG. 1, in which the umbrella is in an open state.
Figure 3:
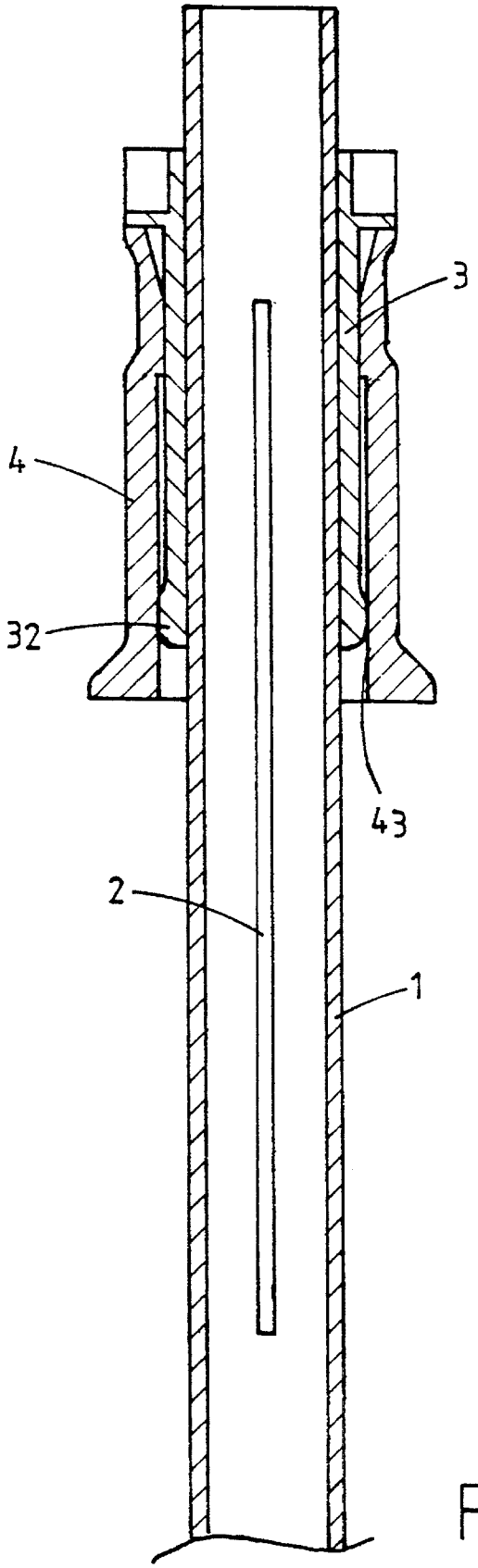
FIG. 3 is a schematic view explaining the safety runner kept in position by a resilient bow lever when the umbrella is in an open state.
Figure 4:
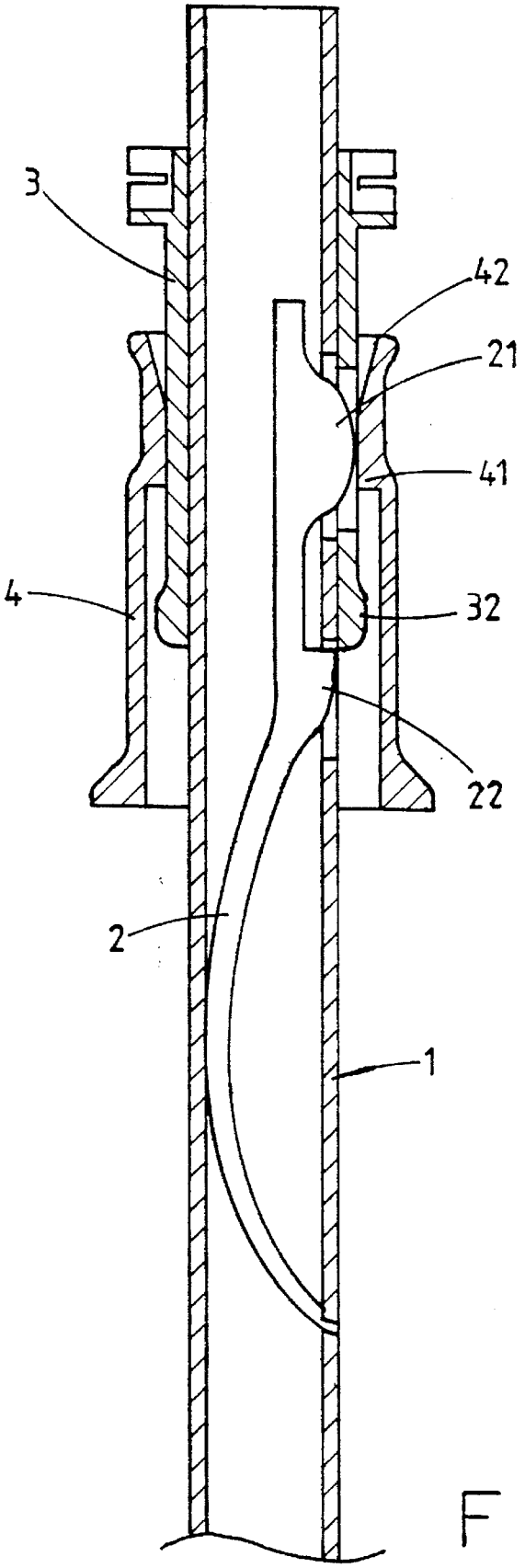
FIG. 4 is an assembly drawing of the safety runner of FIG. 1, in which the umbrella is in a closed state.

Referring to FIGS. 1 to 3, this invention consists of an umbrella rod (1), a resilient bow lever (2), a runner element (3), and a slidable sleeve (4). The umbrella rod (1) is equipped with two slots (11) and (12) on one side. The resilient bow lever (2) has a convex portion (21) and a raised portion (22) and is seated inside the tubular umbrella rod (1), with the lower end fixed and the upper end depressible. The runner element (3) embracing an umbrella rod (1) has a long slot (31) on its cylindrical surface and an external flange (32) at its lower end. The upper portion of the slidable sleeve (4) has an internal flange (41) formed thereon. The slidable sleeve (4) surrounds the runner element (3) and is kept by the external flange (32) from separation. The upper end of the internal flange (41) extends to the open end of the sleeve (4) to form a tapered portion (42). Abutting against the lower end of the flange (41) are a plurality of ribs (43), which define a space having a diameter slightly smaller than the outside diameter of the external flange (32) of the runner element (3).

When the umbrella is opened, the runner element (3) is supported by the raised portion (22) of the resilient bow lever (2) to stop at an upper position and the slide sleeve (4) surrounds the runner element (3), with the ribs (43) clinging to the external flange (32) of the runner element (shown in FIG. 3), so that the slide sleeve (4) also stops at the upper position. When closing the umbrella, users pull the slidable sleeve (4) downwards and the convex portion (21) of the resilient bow lever (2) will be depressed inwardly as the internal flange (41) passes over it so that the raised portion (42) also retreats inwardly to release the detention of the runner element (3). Hence, the downward motion of the slidable sleeve (4) can directly drive an umbrella to close.

From the foregoing description, apparently the invention provides an advantage of closing an umbrella by clasping a slidable sleeve instead of the runner element. It gets rid of contacts with an umbrella runner or a resilient bow lever and so can avert the danger of hand injuries during operating an umbrella and enable an umbrella to be closed in an easy and simple way.

What is claimed is:

1. A safety runner for use in an umbrella, consisting of an umbrella rod that contains a resilient bow lever inside and a runner element embracing the umbrella rod and having an external flange formed on the lower end thereof; and characterized in that a slidable sleeve surrounding said runner element and mounting on said external flange has an internal flange arranged on the upper portion thereof and extending to the upper opening thereof to form a tapered portion and further has a plurality of vertical ribs disposed under the internal flange, which ribs define a space having a diameter slightly smaller than the outside diameter of said external flange of said runner element; and in that when said slidable sleeve is in its upper position said ribs closely cling to the outer cylindrical surface of said external flange of said runner element and when the slidable sleeve moves downwards said internal flange presses said resilient bow lever inwards to let go said runner element and close an umbrella.

* * * * *